US005280900A

United States Patent [19]

Hannon

[11] Patent Number: 5,280,900

[45] Date of Patent: Jan. 25, 1994

[54] CONVERTIBLE METERING HOPPER FOR THIN SINGLE SHEET AND BULKY MULTIPLE SHEET ARTICLES

[75] Inventor: Charles N. Hannon, Olathe, Kans.

[73] Assignee: Stepper, Inc., Olathe, Kans.

[21] Appl. No.: 117

[22] Filed: Jan. 4, 1993

[51] Int. Cl.[5] ..... B65H 3/30; B65H 3/08

[52] U.S. Cl. ..... 271/23; 271/100; 271/162; 271/166

[58] Field of Search ..... 271/11, 12, 16, 19, 271/20, 100, 107, 162, 165, 166, 171, 21, 23

[56] References Cited

U.S. PATENT DOCUMENTS

| | | | |
|---|---|---|---|
| 2,817,513 | 12/1957 | Bell et al. . | |
| 3,269,720 | 8/1966 | Schluckebier et al. . | |
| 3,275,316 | 9/1966 | Cleary, Jr. . | |
| 3,282,586 | 11/1966 | Schwebel . | |
| 3,561,751 | 2/1971 | Dutro . | |
| 3,608,891 | 9/1971 | Hannon et al. . | |
| 3,661,379 | 5/1972 | Dolfini . | |
| 3,672,667 | 6/1972 | Pahlitzsch . | |
| 3,734,488 | 5/1973 | Hannon et al. . | |
| 3,889,801 | 6/1975 | Boyer . | |
| 4,702,467 | 10/1987 | Hannon | 271/19 X |
| 4,712,783 | 12/1987 | Selak | 271/100 |
| 5,054,759 | 10/1991 | Lohrmann et al. | 271/162 X |
| 5,125,637 | 6/1992 | Glaser | 271/11 |

*Primary Examiner*—D. Glenn Dayoan

*Assistant Examiner*—Boris Milef

*Attorney, Agent, or Firm*—Hovey, Williams, Timmons & Collins

[57] ABSTRACT

A metering hopper which utilizes an oscillating friction pad to engage and initiate the feeding of successive, bulky newspaper sections or the like from the bottom of a stack may be converted into a machine using a vacuum separating feeder for thin, single-sheet articles by disabling the rocker pad assembly and bolting in place a tray module having an essentially self-contained oscillating vacuum sucker head assembly. When the tray is installed, the self-contained oscillating mechanism for the sucker head assembly makes operable engagement with pre-existing drive means on the machine so as to carry out the necessary rocking action of the sucker heads in timed relationship with other functions of the machine. Connecting the sucker assembly to vacuum control mechanism and a source of vacuum pressure completes the conversion. Separation of the lowermost article from the next higher article is carried out by causing the sucker heads to adhere themselves to the bottom surface of a leading marginal edge of the lowermost article, bend such marginal edge downwardly away from the rest of the stack, and present the edge to awaiting, high speed delivery nip rollers which take control of the article and finish its withdrawal from the bottom of the stack.

34 Claims, 4 Drawing Sheets

5.
5.

6.
6.

CONVERTIBLE METERING HOPPER FOR THIN SINGLE SHEET AND BULKY MULTIPLE SHEET ARTICLES

TECHNICAL FIELD

This invention relates to the field of newspaper handling equipment and, more particularly, to a machine which may be quickly and easily set up for feeding either bulky, multiple sheet articles such as big city newspapers, or thin, single sheet articles such as one-page advertising flyers and the like.

BACKGROUND

My prior U.S. Pat. Nos. 3,608,891 and 3,734,488 disclose and claim a machine known as a "rocker hopper" which is especially well suited for feeding bulky newspaper sections at a predetermined, metered rate of delivery as part of an overall system for assembling and collating various sections of a big city newspaper. The rocker hopper disclosed in such patents utilizes an oscillating gripper pad that underlies the bottom-most article in the hopper and oscillates through both a reverse stroke and a subsequent forward stroke during each cycle of operation. As the rocker swings rearwardly, it engages the bottom surface of the lowermost article and thus pulls a leading marginal edge of the article off of a forwardly located shelf which supports the front margin of the stack. This has the effect of separating the leading edge of the lowermost edge of the article from the rest of the stack.

Then, as the rocker swings forwardly, the separated leading edge of the lowermost article is presented to a pair of nip rollers that grab the article and quickly pull it completely out of the stack, feeding it to the main collating line or other part of the system.

While the oscillating rocker pad performs extremely well for bulky, multiple page newspaper sections, it is not well-suited for dispensing thin, single-sheet articles such as advertising fliers and the like. When folded newspaper sections are dispensed, they are arranged in the hopper with their "hard" folded edge leading and with the two halves of the section superimposed upon one another. Thus, as the rocker sweeps rearwardly in engagement with the bottom half of the newspaper section and pulls it rearwardly off the front shelf, the upper half of the newspaper necessarily moves along with it due to the interconnection presented by the folded edge. However, when thin, single-sheet articles are involved, it is difficult for the rocker pad to overcome the significant frictional drag between the lowermost article and the next higher article. Consequently, there is a tendency to feed "doubles" or "triples", instead of only one sheet at a time.

SUMMARY OF THE INVENTION

Accordingly, one important object of the present invention is to provide a way of relatively quickly and easily converting a rocker hopper machine which utilizes oscillating rocker pads into a machine which is better suited for feeding thin, single sheet articles. In this regard, it is an important object of the invention to provide a way of disabling the rocking gripper and effectively replacing its function with a vacuum sucker head assembly that performs the roll of separating the leading margin of the lowermost article from the rest of the stack and presenting it to the nip rollers for subsequent withdrawal of the article from the stack. It is important in this respect that the machine be readily interchangeable between the rocker pad and vacuum separator configurations so that the end user can relatively easily adapt the machine to meet the particular needs at hand, which can sometimes vary from day-to-day.

In carrying out the foregoing and other objects, the present invention contemplates a tray-like module which is inserted into the machine and bolted in place after the rocker pads have first been disabled and the existing rear support deck for the newspaper sections has been removed. The tray has a series of sucker heads along the leading extremity which are arranged to rock in unison between raised and lowered positions during each operating cycle for the purpose of attaching themselves to the lower surface of the bottom article in the stack and bending the leading marginal edge of such bottom article down into a position where it can be gripped by the high speed nip rollers, which in turn pull the entire article out of the stack and feed it in the delivery direction.

The tray module includes its own oscillating mechanism for the vacuum sucker heads which is designed to be connected with and to utilize the power of the existing input drive train of the machine.

DETAILED DESCRIPTION

Figure 1:
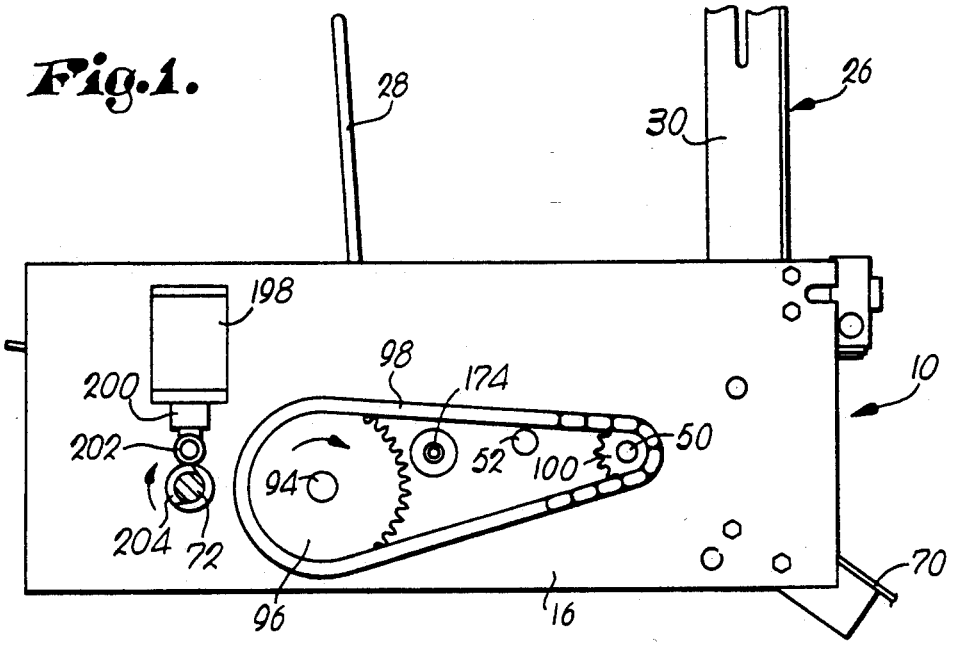
FIG. 1 is a side elevational view of a rocker hopper of the type disclosed in prior U.S. Pat. Nos. 3,608,891 and 3,734,488.
Figure 3:
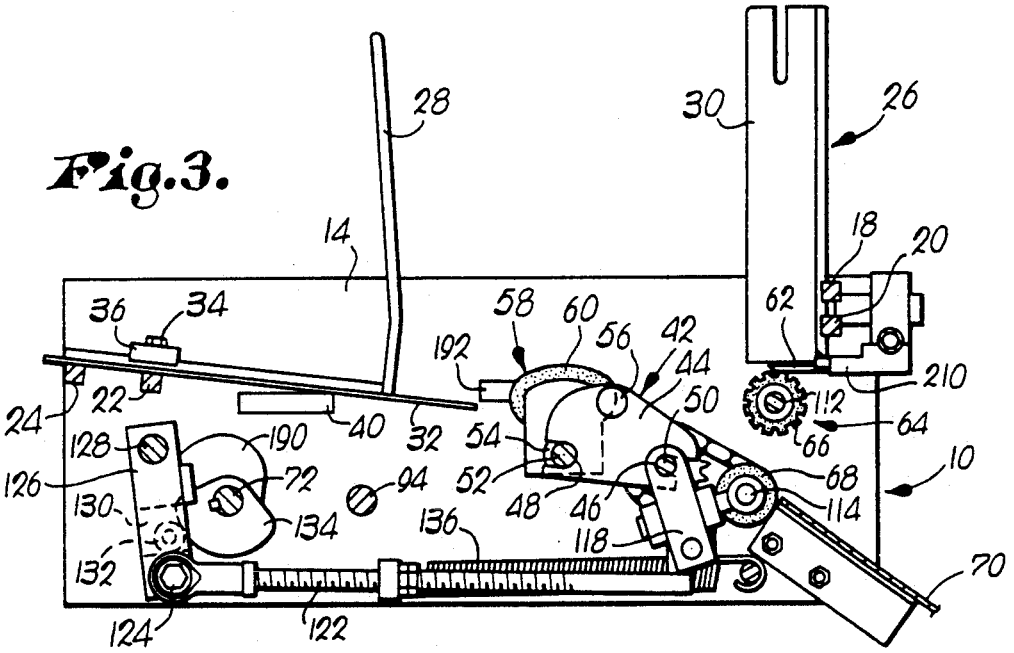
FIG. 3 is a longitudinal, vertical cross-sectional view through the machine showing the nature of the oscillating rocker gripper.
Figure 2:
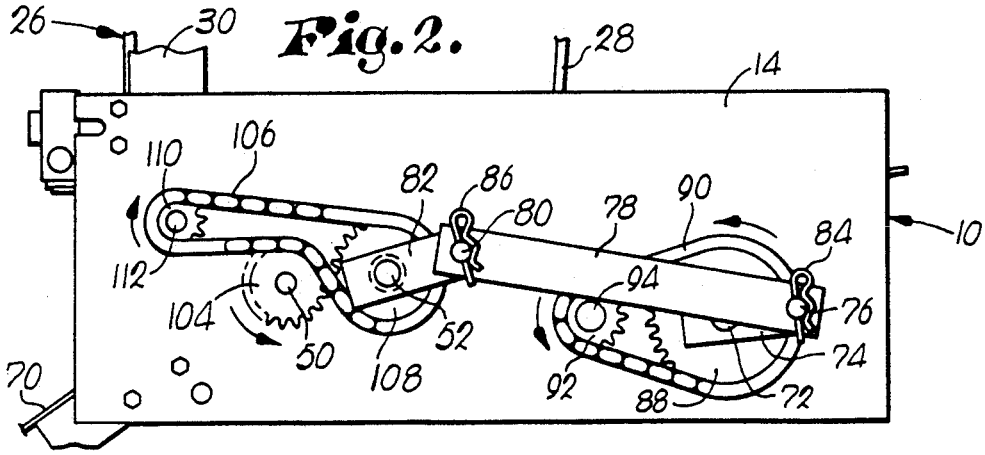
FIG. 2 is an opposite side elevational view thereof.

The machine illustrated in FIGS. 1–3 is generally the same as the rocker hopper disclosed in the above-mentioned patents, with a few exceptions which will be hereinafter explained in more detail in connection with the description of the vacuum tray module which may be inserted into the machine. In order to provide a full and complete understanding of the nature and operation of the present invention, the '891 and '488 patents are hereby incorporated by reference into the present specification.

Broadly speaking, the machine includes a chassis 10 consisting primarily of a pair of opposite left and right sidewalls 14 and 16, respectively, interconnected by a number of transverse bars and other members such as the transverse structural members 18, 20, 22, and 24. A hopper 26 for receiving a stack of bulky newspaper articles or the like projects upwardly from between the sidewalls 14,16 and is supported generally in the front, central portion of the machine. In the illustrated embodiment, the hopper 26 is defined in part by the opposite sidewalls 14,16, and also by upright confinement structure 28 and 30 located at fore-and-aft spaced positions on the machine. The rear confinement structure 28 is carried on a flat, rectangular deck 32 that spans the sidewalls 14,16 and rests upon the transverse structural members 22 and 24 at a slight downward and forward incline, as illustrated in FIG. 3. Threaded fasteners 34 (FIG. 3) detachably secure the deck 32 to the underlying structural member 22, the fasteners 34 (only one being shown) serving also to clamp a crossbar 36 down against a rearward leg 38 of the rear upright structure 28 for the purpose of releasibly holding the structure 28 in a selected fore-and-aft position of adjustment. The deck 32 also rests upon the front corners of a pair of horizontally disposed shoulder blocks 40 on sidewalls 14 and 16 as illustrated in FIG. 3 with respect to the sidewall 14.

At the bottom of the hopper 26, a transverse support unit 42 spans the two sidewalls 14,16 and is supported thereby in position to underlie and support the central portion of a stack of articles within the hopper 26. The support unit 42 is a stationary support, but can be substantially disassembled and laid aside when the machine is converted to a vacuum hopper. In this respect, although not shown in detail in the drawings, it is to be understood that support unit 42 broadly includes a plurality of laterally spaced apart, upright, generally hump-shaped discs 44 that have cutouts or notches 46 and 48 at their opposite fore-and-aft edges, respectively. The notches 46,48 serve as means for mounting each of the discs 44 on a pair of transverse shafts 50 and 52 that span the sidewalls 14,16 and provide driving power for certain components of the machine, as will hereinafter be made clear. The discs 44 are held in place along the shafts 46,48 by releasable set collars 54 (FIG. 3) on opposite sides of each disc 44. However, when the set collars 54 are released, each of the discs 44 can be manually twisted sideways to disengage the notches 46,48 from the shafts 50,52 and thus allow each of the discs 44 to be completely removed. This effectively removes the entire support unit 42 from the machine. An anti-friction roller 56 may be provided at the upper extremity of each disc 44 to minimize frictional drag against the bottom of the stack of articles during operation.

Also located at the bottom of the hopper 26 is an oscillating rocker pad assembly 58 which includes a series of individual rocker pads 60 fixed to and spaced along the shaft 52, only one of such pads 60 being illustrated in the drawings. The pads 60 and the support discs 44 are interspersed alternately between one another along the length of the shaft 52 when the machine is set up in the manner illustrated in FIGS. 1–3. Generally speaking, the rocker pad 60 oscillates between the rocked back position of FIG. 3 and a fully rocked forward position somewhat above the disabled position illustrated in FIG. 5.

The rocking motion of the pads 60 is for the purpose of retracting the leading marginal edge for the lowermost article in the stack off of one or more short, front shelves 62 and then presenting such leading edge to delivery mechanism 64 in the form of a pair of driven nip rollers 66 and 68, all as fully explained in the '891 and '488 patents. The driven nip rollers 66 and 68 are shown in a spaced apart or "open" relationship in FIG. 3, but after the leading edge of the lowermost article has been introduced into the gap between the rollers 66,68, the lower roller 68 is snapped up into a contacting position with the upper roller 66 so that the article is clamped between the two rollers 66,68. Once the rollers 66,68 take control of the article, they pull it completely out of the stack and send it in a delivery direction down the discharge ramp 70 of the machine.

Figure 4:
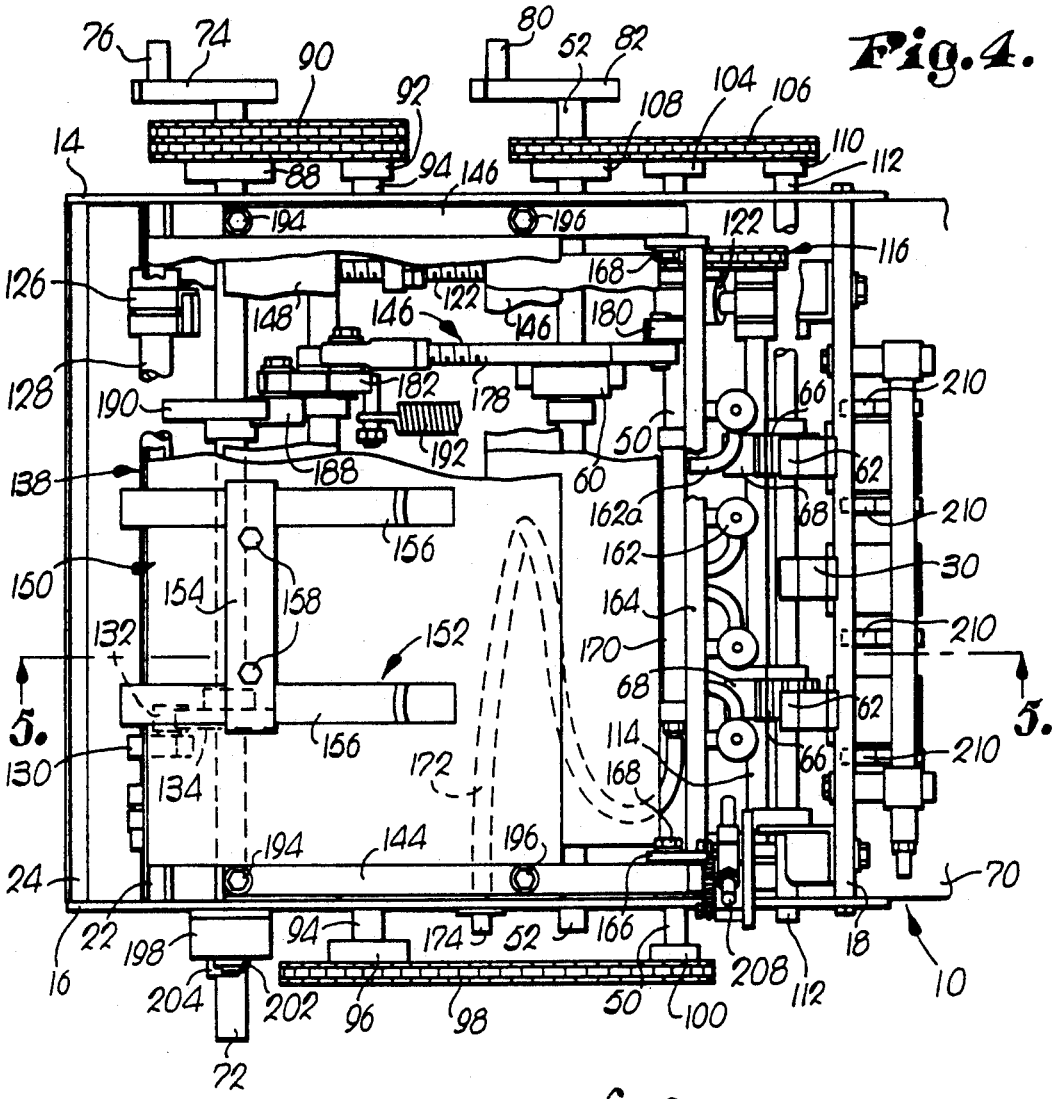
FIG. 4 is a top plan view of the machine as modified in accordance with the principles of the present invention to include a vacuum separator assembly that renders the machine suitable for feeding single sheet articles.

Input power for oscillating the rocker pads 60, rotationally driving the rollers 66,68, and opening and closing the gap between the rollers 66,68 is derived from an input drive shaft 72 that spans the two walls 14,16 adjacent the lower rear portion of the machine. As illustrated in FIG. 4, the input shaft 72 projects outwardly beyond the opposite sidewalls 14,16. The end of the shaft 72 which projects beyond the sidewall 16 is directly coupled with a source of driving power (not shown).

At its exit location from the left sidewall 14, the drive shaft 72 carries a crank 74 (FIGS. 2 and 4) which rotates with the shaft 72 in a counterclockwise direction, viewing FIG. 2. The crank 74 has an outwardly projecting pivot pin 76 at the outer end thereof which pivotally connects with the rear end of a fore-and-aft extending pitman link 78 shown in FIG. 2. The pitman link 78, in turn, is pivotally connected at its forward end with the outwardly projecting pivot pin 80 on another crank 82 that is fixed to the outer end of the rocker shaft 52 on which the rocker pads 60 are mounted. Thus, rotary motion of the input drive shaft 72 is translated into oscillating motion of the rocker shaft 52 and pads 60. A pair of detachable keeper pins 84 and 86 (FIG. 2) may be inserted into corresponding receiving holes (not shown) in the pivot pins 76,80 to maintain the pitman link 78 securely coupled with the pivot pins 76 and 80. Removal of the keeper pins 84 and 86 allows the pitman link 78 to be slipped off the pivot pins 76 and 80 to thereby disable the rocker pads 60, such disabled condition being illustrated, for example, in FIG. 4 and FIG. 5.

In order to provide the necessary rotational driving power for the nip rollers 66 and 68, the left end of the drive shaft 72 which projects outwardly beyond the left sidewall 14 is provided with a sprocket 88 that is entrained by a drive chain 90. The chain 90 is also trained around a smaller, forwardly disposed sprocket 92 which is fixed to the proximal outer end of a jack shaft 94 passing completely across the machine and exiting through the right sidewall 16. At its exit point from the right sidewall 16, the jack shaft 94 carries a sprocket 96 that is entrained by a fore-and-aft chain 98 which also entrains a forwardly disposed sprocket 100 on the shaft 50 that crosses back to the far side of the machine. On the outside of the sidewall 14, the shaft 50 carries a sprocket 104 that is back-wrapped by a drive chain 106. The chain 106 is also entrained around a rearwardly located idler sprocket 108 journalled on the rocker shaft 52 and a forwardly disposed drive sprocket 110 fixed to the outer end of a cross shaft 112 that spans the two sidewalls 14 and 16. The upper nip rollers 66 are fixed to the cross shaft 112 for rotation therewith, while the lower nip rollers 68 are fixed to a short shaft 114 driven by the shaft 50 via a chain and sprocket assembly 116 located just inside the left sidewall 14.

In order to provide the opening and closing action of the nip rollers 66 and 68, the shaft 114 on which the lower rollers 68 are mounted is itself carried by a pair of opposite swing arms 118 which depend from the shaft 50 generally adjacent opposite ends thereof just inside the sidewalls 14 and 16. The swing arms 118 are provided with suitable bearings (not shown) that enable them to move through the appropriate swinging motions notwithstanding rotation of the shaft 50, such swing arms 118 also being provided with fore-and-aft extending members 120 which are rigid to the respective swing arms 118 and which carry the shaft 114 for driving rotation about its longitudinal axis by the chain and sprocket assembly 116.

At its lower end each of the swing arms 118 has a fore-and-aft extending push-pull rod 122 connected thereto for use in transmitting rocking power from the rear input drive shaft 72 up to the swing arms 118. At the rearmost end of each of the push-pull rods 122, a pivotal connection 124 is made with a generally upright crank arm 126 that is fixed to and depends from a transverse jack shaft 128 journalled at its opposite ends by the two sidewalls 14 and 16. Although it is not clearly apparent from the drawings, there is another crank arm 130 shown only in phantom in FIGS. 3 and 4 which is located between the two crank arms 126 on the jack shaft 128 and which carries a cam follower roller 132 at its lower end. The follower 132 is disposed to engage a generally sector-shaped cam 134 (FIGS. 3 and 4) fixed to the input shaft 72 for rotation therewith. A fore-and-aft tension spring 136 for each push-pull rod 122 is connected between the corresponding sidewall 14,16 and the proximal push-pull rod 122 to bias the crank arms 126 and 130 forwardly so as to maintain the cam follower 132 in engagement with the cam 134. This also yieldably biases the lower nip rollers 68 upwardly toward the upper rollers 66. The net result of this construction is that the lower rollers 68 are snapped up into closing relationship with the upper rollers 66 during each revolution of the input drive shaft 72, and are also opened away from the upper roller 66 during such same revolution.

The foregoing description relates to the machine in its rocker hopper mode, set up for feeding bulky articles such as newspaper sections. If the machine is to be set up for vacuum operation, such as for thin sheet articles, the rocker pad assembly 58 is no longer used. Consequently, it is necessary to disable the rocker pad assembly 58 and to remove the rocker pads 60 from their operating positions illustrated in FIG. 3, for example.

Such disablement is most easily accomplished by pulling the keeper pins 84 and 86 associated with the pitman link 78 in FIG. 2 and then completely removing the pitman link 78 from the connector pins 76 and 80, as illustrated in the top view of FIG. 4. This not only interrupts the transmission of power from the input shaft 72 to the rocker shaft 52, but also allows the rocker pads 60 to swing around by gravity into a downwardly hanging, out-of-the-way position, as in FIG. 5. Additionally, the support unit 42 comprising the series of separate discs 44 is removed by appropriately releasing the set collars 52 and backing them away from the discs 44 a sufficient extent as to allow each of the discs 44 to be manually twisted about individual upright axes until the notches 46 and 48 are moved out of receiving relationship with the shafts 50 and 52, thus allowing the discs 44 to be completely removed and laid to one side.

In addition, the rear deck 32 is removed by releasing the fasteners 34 and then lifting the entire deck 32 and upright containment structure 38 out of the machine. The upright confinement structure 28 and the fasteners 34 and cross bar 36 should be retained for subsequent re-use in the vacuum hopper as will be seen below.

Figure 7:
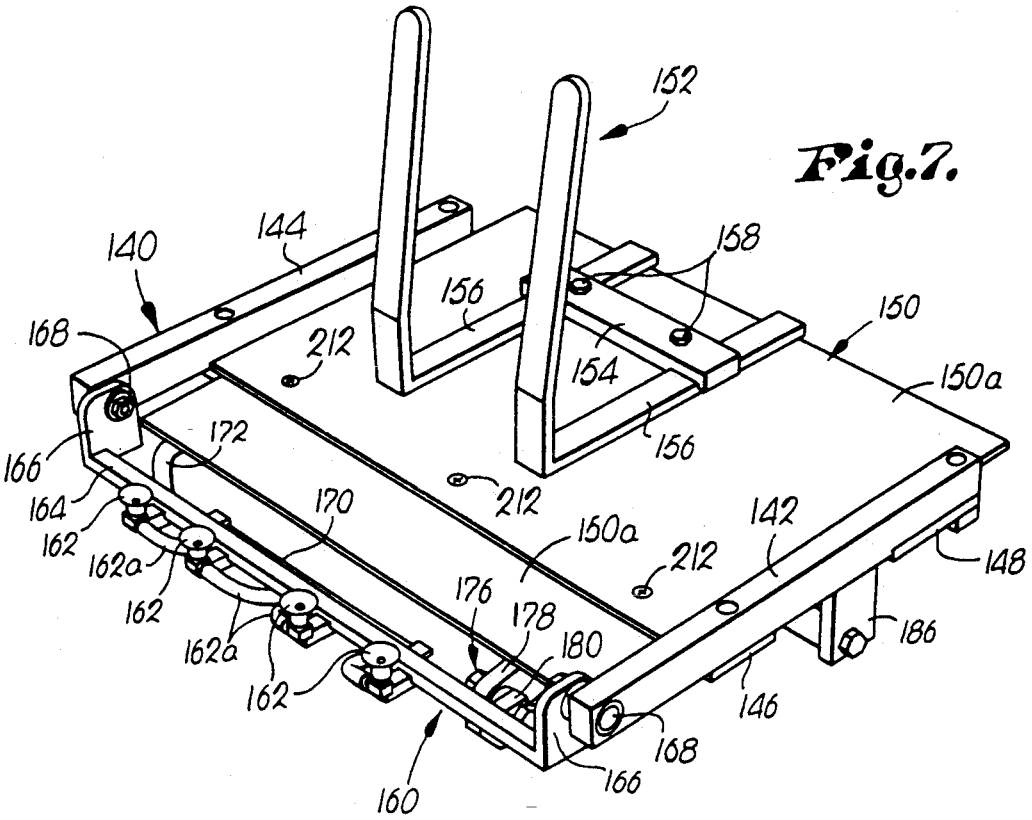
FIG. 7 is a left front perspective view of the vacuum tray module itself.

In lieu of the rocker pad assembly 58, the support unit 48 and the rear deck 32 of the rocker hopper, the machine when configured as a vacuum hopper is provided with a vacuum tray module illustrated in FIG. 7 and broadly denoted by the numeral 138. The module 138 includes a generally rectangular frame 140 that consists of a pair of laterally spaced, fore-and-aft extending side bars 142 and 144 and a pair of transversely extending, flat, rigid straps which are spaced apart in a fore-and-aft direction and which rigidly interconnect the two side bars 142,144 along their bottom surfaces.

A flat, generally rectangular, plate-like deck 150 overlies the straps 146,148 and is fixed thereto between the side bars 142 and 144 to provide a supporting surface for a stack of articles to be dispensed. Generally upright, L-shaped confinement structure 152 serving to define part of a hopper for the stack of articles is secured to the upper face of the deck 150 via a holddown cross bar 154 which spans the fore-and-aft legs 156 of the structure. Threaded fasteners 158 pass into the strap 148 and thus secure the clamping cross bar 154 against the legs 156. Conveniently, the upright structure 152, the clamping cross bar 154, and the fasteners 158 may comprise the same components as utilized in connection with the rocker hopper configuration, i.e., the structure 28, legs 38, clamping cross bar 36, and fasteners 34.

A vacuum separator assembly 160 is secured to the frame 140 across the front of the tray. Such assembly 160 preferably includes a series of vacuum sucker heads 162 fixed to a common cross bar 164 having upright mounting lugs 166 at its opposite ends. The two lugs 166 are pivotally secured to the front ends of the side bars 142 and 144 by respective pivots 168 which thus adapt the assembly 160 for rocking movement between raised and lowered positions. The axis of such rocking movement is defined by the aligned pivots 168 and is parallel with the front terminal edge of the deck 150. The sucker heads 162 are all connected to a common vacuum manifold 170 via individual hoses 162*a*, the manifold 170 lying generally along and behind the cross bar 164 while being rigidly affixed thereto for oscillating or rocking movement therewith. A hose 172 leads from the manifold 170 and is adapted to be connected to a nipple 174 carried by the sidewall 16 as illustrated in FIG. 4.

The separator assembly 160 is raised and lowered by oscillator mechanism broadly denoted by the numeral 176 on the underside of the tray 138. Although such mechanism 176 is partially illustrated in FIG. 7, it is perhaps most clearly seen with reference to other figures which show the tray 138 fully installed within the machine. Consequently, primary reference will hereinafter be made to figures other than FIG. 7 for a description of the oscillator mechanism 176.

Figure 5:
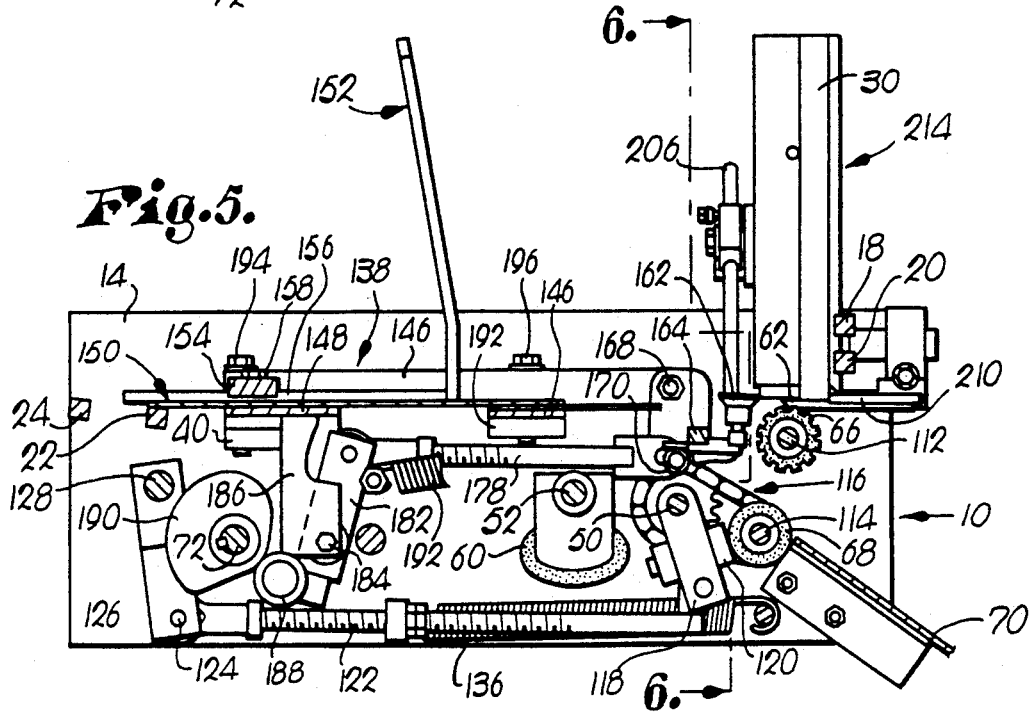
FIG. 5 is a vertical cross-sectional view of the modified machine taken substantially along line 5—5 of FIG. 4.
Figure 6:
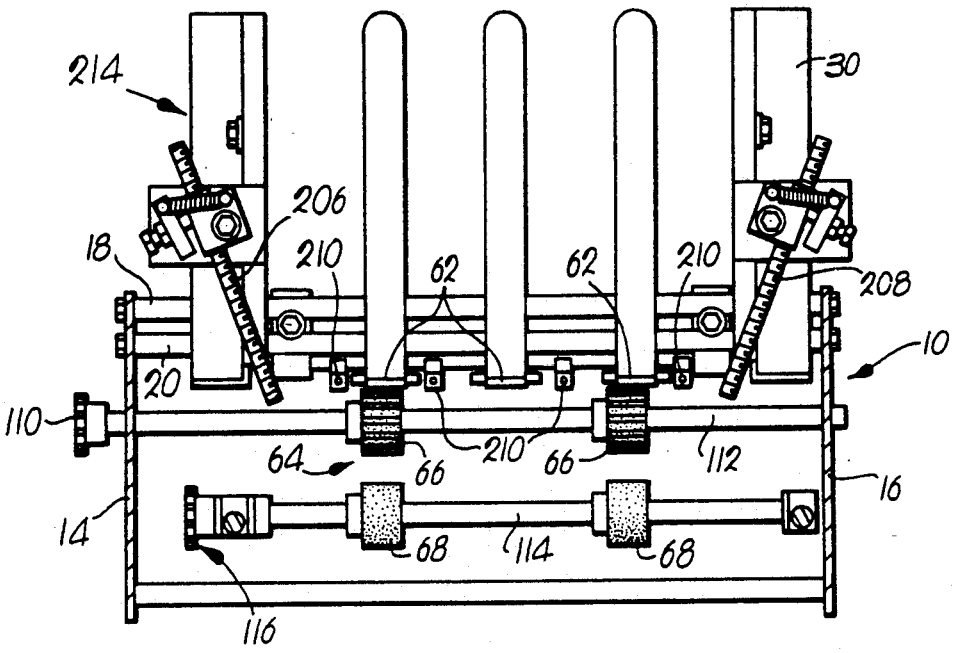
FIG. 6 is a transverse, vertical cross-sectional view of the modified machine taken substantially along line 6—6 of FIG. 5.

For example, as seen in FIGS. 4 and 5, which show the module 138 installed in the machine, the oscillator mechanism 176 includes a fore-and-aft extending push-pull link 178 that is pivotally connected at its forward end with a rearwardly extending lug 180 (FIG. 4) on the bar 164 of the vacuum separator assembly 160. At its rear end, the link 178 is pivotally connected to the upper end of a generally upright lever 182 that is pivoted intermediate its opposite ends via a horizontal pivot 184 to a depending mounting bracket 186 on the rear strap 148 of the frame 140. The lower end of the lever 182 has a cam following roller 188 carried thereby which is in continuous engagement with a generally sector-shaped cam 190 on the drive shaft 72. A tension spring 192 connected between the upper end of the lever 182 and the front strap 146 of the frame 140 yieldably biases the follower 188 into engagement with the cam 190.

In order to support the tray 138 within the confines of the machine, the inside surfaces of the two sidewalls 14 and 16 are each provided with two shoulder blocks, one of which is the rear shoulder block 40 described earlier. The other shoulder block on each sidewall 14,16 comprises a fore-and-aft extending shoulder block 192 which is spaced forwardly from the rear shoulder block 40 generally in the vicinity of the rocker shaft 52. When the tray 138 is placed into the machine between the two sidewalls 14 and 16, the side bars 142 and 144 come to rest on the shoulder blocks 40 and 192, contacted directly by the straps 146 and 148, so that the tray 138 is securely supported. The tray 138 is bolted down into such supported position by a pair of threaded fasteners 194 and 196 on each side bar 142,144. The fasteners 194 and 196 pass down through the side bars 142,144 and into the shoulder blocks 40 and 192.

Figure 8:
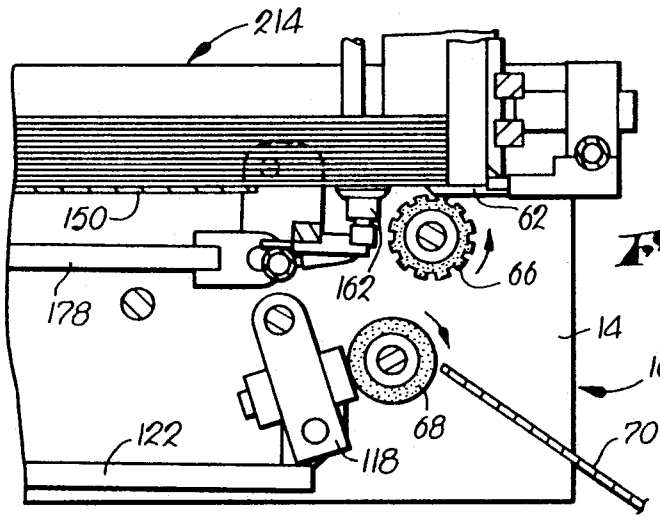
FIGS. 8–11 are schematic, fragmentary views of the modified machine illustrating the manner of operation of the vacuum sucker head assembly.

When the tray 138 is installed in the machine, the leading marginal edge of the deck 150 is spaced rearwardly from the front shelves 62 so that a gap is presented between the deck 150 and the shelves 62. The sucker heads 162 utilize such gap to gain access to the bottom surface of the lowermost sheet article in a stack, as shown in FIGS. 8–11. The oscillator mechanism 176 is operable to rock the sucker heads 162 between the raised position up in the gap as shown in FIG. 8 and a lowered or retracted position down out of the gap, as illustrated in FIG. 11.

Vacuum pressure to the sucker heads 162 during such movement is supplied at controlled intervals, rather than being continuously supplied. In this regard, the preferred embodiment of the invention has vacuum supplied to the sucker heads 162 just immediately prior to the heads 162 reaching their raised positions of FIG. 8, and then remaining on until just prior to the time the sucker heads reach their lowered positions of FIG. 11. The vacuum pressure remains off until the sucker heads 162 are once again rocked back up to a point just slightly below their fully raised positions.

In order to supply and control such vacuum pressure to the sucker heads 162, the hose 172 (FIG. 4) is connected to a source of vacuum supply and to a suitable control system. One such control system is illustrated in FIGS. 1 and 4, although it will be appreciated that other controls may be utilized.

In this regard, FIG. 1 shows a mechanically actuated valve 198 mounted on the sidewall 16 directly above the input drive shaft 72. This valve is also shown in FIG. 4. Although not illustrated in either of those figures, it is to be understood that a vacuum connecting line runs from the valve 198 to the nipple 174 on the sidewall 16. In addition, another hose or supply line (not illustrated) leads from the valve 198 to a suitable vacuum pump (not shown) that constantly draws a vacuum on the line between the pump and the control valve 198. The valve 198 is provided with a vertically reciprocable spool or plunger 200 having a cam follower 202 at its lower end. A sector-shaped cam 204 on the shaft 72 operates the follower 202 during each revolution of the shaft 72, the spool 200 being yieldably biased downwardly into engagement with the cam 204.

The control valve 198 is so designed that when the spool 200 is fully extended, internal porting within the valve 198 causes the sucker heads 162 to be communicated with the vacuum pump such that suction is available at the heads 162. On the other hand, when the cam 204 pushes the spool 200 up into a retracted position, the internal porting is such that the sucker heads 162 are cut off from the vacuum source so that there is no suction supplied to the heads 162 at such time. Preferably, during the time the sucker heads 162 are turned off, they are communicated with ambient air through ports in the control valve 198. Likewise, at such time, the vacuum pump is also communicated with ambient air through ports in the control valve 198 such that the pump is merely drawing on the surrounding air rather than on the sucker heads 162.

In another preferred form of the invention, the mechanically actuated control valve 198 could be replaced by an electronically actuated valve. Instead of having a plunger or spool 200 which is mechanically reciprocated by the cam 204, in the electronic version a micro switch is operated by the cam 204 or its equivalent. Such micro switch opens and closes a control circuit which includes a 24 volt DC valve that opens and closes communication between the vacuum pump and the sucker heads in essentially the same manner as the control valve 198. Preferably, the electronic valve is air assisted so that its reciprocable spindle or spool operates at sufficiently high speeds as to turn the suction to the heads off and on at precisely the right times in the operating cycles of the heads. One such electronic valve which has been found suitable for use in the vacuum hopper is a 24 volt DC ISI valve, part number 250-02-001-64, which is available from the Skarda Company of Omaha, Nebraska.

To assist the sucker heads 162 in separating the lowermost sheet from the next higher sheet in the stack, the vacuum hopper configuration preferably includes a pair of separator assist rods 206 and 208 which are carried by the front confinement structure 30 generally at opposite front corners of the stack and converge downwardly and inwardly toward one another. The rods 206 and 208 are positioned to engage the opposite side edges of articles in the stack, rather than the front edge of the stack, and as a result of the threaded nature of the rods 206,208, there is a certain measure of mechanical or frictional separation of the articles which takes place due to their engagement with the rough surfaces presented by the threads. Still further, a series of positive pressure air jets 210 supported along the front of the machine face rearwardly toward the hopper area at the same level as the bottom-most article in the stack so as to aid in separation. In a preferred arrangement the air jets 210 direct air streams over several of the lower articles in the stack, rather than just the lowermost article itself, so as to avoid interfering with the suction attaching ability of the heads 162.

OPERATION OF THE VACUUM HOPPER CONFIGURATION

When the machine is set up in the vacuum hopper configuration of FIGS. 4–11, the front upright confinement structure 30 and the rear confinement structure 152 cooperate with the sidewalls 14 and 16 to define a hopper 212 that is adapted to receive an upright stack of thin, single sheet articles such as illustrated in FIGS. 8–11. While the rear portion of the stack is supported by the deck 150 and the leading front marginal portion of the stack is supported by the shelves 62, there is an intermediate portion of the stack that overlies the gap between the deck 150 and the shelves 62. This unsupported area provides access for the sucker heads 162 to the bottom surface of the lowermost article in the stack, as illustrated in FIG. 8.

When the sucker heads 162 are in their fully raised position, as illustrated in FIG. 8, the vacuum is on and the sucker heads 162 adhere themselves to the bottom surface of the lowermost article. At that time, the nip rollers 66 and 68 are in a separated condition, awaiting presentation of the leading edge of the lowermost article thereto.

Figure 9:
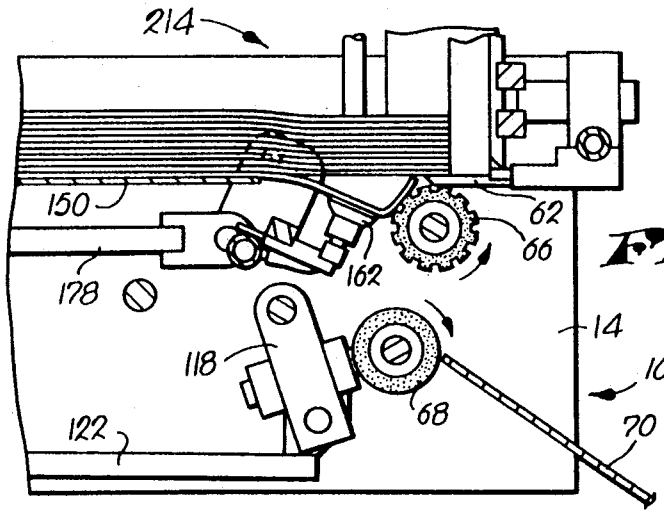

As the sucker heads 162 begin to retract, as shown in FIG. 9, they bend the front margin of the lowermost article downwardly about the front edge of the deck 150, pulling the leading edge of the article rearwardly off the shelves 62 and causing the article to contact the downwardly moving rear periphery of the upper nip rollers 66.

Figure 10:
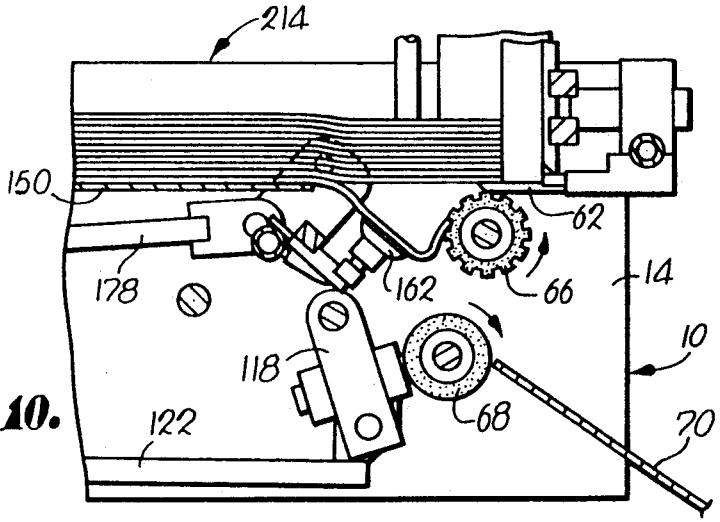
Figure 11:
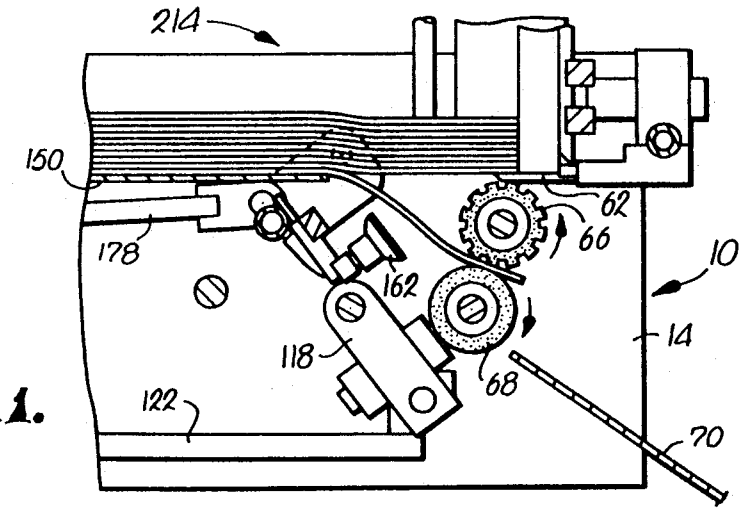

As the sucker heads 162 retract further, as shown in FIG. 10, and begin to approach their fully lowered positions of FIG. 11, the suction remains on and the leading edge of the article is bent further downwardly into proper feeding position for the nip rollers 66,68. It will be noted, as illustrated in FIG. 10, that due to the notched and irregular configuration of the upper nip rollers 66, the leading outermost edge of the lower article actually becomes engaged within one of the notches and driven positively downwardly into a position below such rollers, thus aiding in proper presentation of the leading edge to the gap between the rollers.

Finally, by the time the sucker heads 162 have been fully retracted to their FIG. 11 position, the leading edge of the article has reached its position between the nip rollers 66 and 68 and those rollers have snapped closed about the leading edge in order to take control of the article. Just before the rollers 66 and 68 grab onto the article, the vacuum to the sucker heads 162 is shut off, causing them to release their adhering grip on the article.

As soon as the nip rollers 66 and 68 take control of the article, they instantly pull it edgewise out of the stack and off the deck 150, propelling it down the discharge ramp 70 for further handling. Thereupon, the sucker heads 162 are rocked back up into their attaching positions of FIG. 8, as the vacuum pressure is once again commenced.

In order to facilitate conversion of a rocker hopper to a vacuum hopper, and vice versa, it is contemplated that the machine leaving the factory as a rocker hopper will nonetheless be provided with a cam 190 on the drive shaft 72, shoulder blocks 40 and 192, and the vacuum control valve 198 or its electronic equivalent. The cam 204 for such valve may or may not be initially supplied with the machine. In that way, once the rocker pad assembly 58 has been disabled, the support discs 44 removed, and the rear deck 32 taken out of the rocker hopper, it is a relatively simple procedure to drop the tray module 138 in place onto the shoulder blocks 40,192, tighten the threaded fasteners 194,196, and connect the appropriate vacuum hoses. The separator rods 206 and 208 may be added at such time, and the air jets 210 may likewise be added if they have not been initially supplied with the machine. Conversion of the vacuum hopper back to the rocker hopper configuration is a simple and quick reversal of the foregoing process.

In one preferred form of the invention the deck 150 of the tray 138 is constructed from two overlapping, rectangular plates **150*a* and 150*b* as illustrated best in FIGS. 5 and 7. While the larger plate 150*a* is secured in one permanent position, the smaller, forwardly disposed plate 150*b* is adjustably attached to the larger plate 150*a* for horizontal adjusting movement toward and away from the vacuum assembly 160 for purposes of adjusting the size of the gap defined between the front edge of the deck 150 and the front shelf 62. Although not illustrated in detail, it is to be understood that such adjustability may be provided for by having flat-head screws 212 in the plate 150*a* pass through fore-and-aft slots (not shown) in the bottom plate 150*b* before entering tapped holes in the strap 146 so that, by slightly loosening the screws 212, the plate 150*b*** may be shifted fore-and-aft to the extent permitted by the slots.

It has been found that, generally speaking, a small gap works best for single sheet articles, while an increasingly larger gap is better as the number of sheets increases. If too large of a gap is used for thin, single sheet articles, the next higher sheet in the stack tends to sag down into the gap as the lowermost article is flexed downwardly by the sucker heads 162, thus increasing the likelihood that "doubles" or "triples" will be fed. On the other hand, if too small of a gap is used for thicker multiple sheet articles on the order of 10 to 12 pages, for example, it is difficult for the leading margins of such articles to flex downwardly about the short radius that is created, thus making it hard for the sucker heads 162 to stay attached to the article. Consequently, the articles simply get stuck in the machine and refuse to be fed.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. In a machine for feeding sheet articles seriatim from the bottom of a stack at a metered rate, the improvement comprising:

means defining a hopper for receiving a stack of the articles to be fed;

a front shelf at the bottom of the hopper disposed to support the bottom of the stack along a front marginal edge thereof with respect to a direction of feed of the articles;

delivery mechanism disposed below said front shelf in position for receiving a leading edge of the lowermost article in the stack when such leading edge is pulled down off the shelf and presented to the delivery mechanism, said delivery mechanism then being operable to pull the lowermost article out of the stack and to feed such article in the feeding direction to a point of delivery;

a support normally spaced rearwardly from the shelf in position to underlie the central part of the stack, said support being removable from said position;

a feeding rocker located at the bottom of the hopper and normally operable during each operating cycle at such location to pull the leading edge of the lowermost article back off the shelf as the rocker rocks back away from the shelf and to then present the leading edge down to the delivery mechanism as the rocker rocks forwardly toward the delivery mechanism, said rocker being removable from said location;

drive means connectable with the rocker, said rocker being disconnected from said drive means when the rocker is removed from said location;

a thin sheet feeding module received in the hopper when said support is removed, said module including:

a frame, a bottom support carried by the frame in position for supporting a stack of thin sheet articles to be fed, said bottom support being spaced rearwardly from said shelf to define a gap across which the lowermost thin sheet article extends as the stack is carried cooperatively by the support and the shelf, a vacuum sucker head pivotally mounted on said frame for rocking movement between a raised attaching position in which the head is swung up into the gap for attaching engagement with the front margin of the lowermost thin sheet article and a lowered delivery position in which the sucker head presents the front margin to the delivery mechanism after pulling the front margin down off the shelf, and power transmitting apparatus operably coupling said sucker head with the drive means for effecting said rocking movement of the sucker head.

2. In a machine as claimed in claim 1, said delivery mechanism including a pair of cooperating nip rollers.

3. In a machine as claimed in claim 1, said vacuum sucker head comprising one of a series of separate sucker heads mounted on a common rocker bar which extends generally along a terminal edge of the bottom support, said bar having means at opposite ends thereof swingably mounting the bar on the frame for oscillation about an axis generally parallel to the bar and said terminal edge of the bottom support, said power transmitting apparatus comprising oscillating mechanism operably coupled with said rocker bar.

4. In a machine as claimed in claim 3, said drive means including a rotary drive shaft, said drive shaft having a cam thereon and said oscillating mechanism including a follower in engagement with said cam for operating the oscillating mechanism.

5. In a machine as claimed in claim 4, said follower being provided with means yieldably biasing the follower into engagement with said cam.

6. In a machine as claimed in claim 5, said oscillating mechanism including a motion-transmitting, push-pull link between the follower and the rocker bar of the sucker assembly.

7. In a machine as claimed in claim 1, said frame having a pair of opposite side bars and transverse structure rigidly interconnecting said side bars, said bottom support comprising a deck extending between said side bars and overlying said structure.

8. In a machine as claimed in claim 7, said machine including a pair of upright lateral sidewalls, each having inwardly projecting shoulder means on an upright, inner surface thereof, said side bars of the module frame being disposed to rest on said shoulder means when the module is installed in the machine, each of said side bars having means for detachably securing the side bars to the shoulder means.

9. In a machine as claimed in claim 1, said frame including means for detachably securing the module to the machine.

10. In a machine as claimed in claim 1, said module being a tray having an upper surface disposed to support a stack of articles, said vacuum sucker head being located at one end of the tray, said power transmitting apparatus being secured to the tray beneath said upper surface thereof.

11. An add-on module for use in converting a machine which feeds bulky, multiple-sheet articles seriatim from a stack thereof at a metered rate of delivery into one which feeds thin, single-sheet articles, said machine being provided with drive means for supplying driving power to moving components of the machine, said module comprising:

a frame;

a support carried by the frame in position to underlie a stack of thin articles in such a manner that a marginal edge portion of the stack overhangs a terminal edge of the support;

a vacuum sucker head assembly carried by the frame adjacent said terminal edge of the support for separating the overhanging portion of the lowermost thin sheet from the remainder of the stack, said sucker head assembly including at least one vacuum sucker head movable between a raised position in which the sucker head is disposed for attaching itself to the overhanging portion of the lowermost sheet and a lowered position in which the sucker head is disposed for releasing its engagement with the overhanging portion after pulling it down into a disposition to be gripped by other delivery means;

oscillator mechanism carried by the frame and operably coupled with the sucker head for effecting said oscillating movement of the sucker head; and means for operably coupling the oscillator mechanism with the drive of the machine when the module is installed on the machine.

12. A module as claimed in claim 11, said sucker head assembly including a series of separate sucker heads mounted on a common rocker bar which extends generally along said terminal edge of the support, said bar having means at opposite ends thereof swingably mounting the bar on the frame for oscillation about an axis generally parallel to the bar and said terminal edge of the support, said oscillating mechanism being operably coupled with said rocker bar.

13. A module as claimed in claim 12, said drive means including a rotary drive shaft, said operable coupling means comprising a cam on said shaft and a cam follower on said oscillating mechanism engaged with said cam.

14. A module as claimed in claim 13, said follower being provided with means yieldably biasing the follower into engagement with said cam.

15. A module as claimed in claim 14, said oscillating mechanism including a motion-transmitting, push-pull link between the follower and the rocker bar of the sucker assembly.

16. A module as claimed in claim 11, said drive means including a rotary drive shaft, said operable coupling means comprising a cam on said shaft and a cam follower on said oscillating mechanism engaged with said cam.

17. A module as claimed in claim 16, said follower being provided with means yieldably biasing the follower into engagement with said cam.

18. A module as claimed in claim 17, said oscillating mechanism including a motion-transmitting, push-pull link between the follower and the rocker bar of the sucker assembly.

19. A module as claimed in claim 11, said frame including a pair of opposite sidebars and transverse structure rigidly interconnecting said sidebars, said support including a deck extending between said sidebars and overlying said structure.

20. A module as claimed in claim 19, said machine including a pair of upright lateral sidewalls, each having inwardly projecting shoulder means on an upright, inner surface thereof, said sidebars of the module frame being disposed to rest on said shoulder means when the module is installed in the machine, each of said sidebars having means for detachably securing the sidebars to the shoulder means.

21. A tray module for use in enabling a sheet article feeding machine to feed relatively thin sheet articles at a metered rate of delivery, said module including:

a tray having an upper surface for supporting a stack of the articles;

means on said upper surface of the tray for positioning the stack of articles in such a manner that a marginal edge portion of the stack overhangs and projects outwardly beyond one end of the tray;

a vacuum separator assembly mounted on said one end of the tray and operable to adhere to and bend a marginal portion of the lowermost article in the stack downwardly away from the next higher articles in the stack for presentation to other mechanism of the machine;

drive mechanism carried by the tray for operating the separator assembly; and means for detachably securing the tray in place within the machine.

22. A tray module as claimed in claim 21, said vacuum separator assembly including at least one vacuum sucker head mounted for oscillating movement between a raised position for attachment to an overlying article and a lowered position for bending the article away from the next higher article in the stack, said drive mechanism including means for effecting said oscillating movement of the sucker head.

23. A tray module as claimed in claim 21, said tray including a frame having a pair of opposite side bars and transverse structure rigidly interconnecting said side bars, said upper surface of the tray being presented by a deck extending between said side bars and overlying said structure.

24. A tray module as claimed in claim 23, said machine including a pair of upright lateral sidewalls, each having inwardly projecting shoulder means on an upright, inner surface thereof, said side bars of the module frame being disposed to rest on said shoulder means when the module is installed in the machine, each of said side bars having means for detachably securing the side bars to the shoulder means.

25. A tray module as claimed in claim 21, said upper surface including a plate having a transverse edge presenting said one end of the tray, said plate being adjustably mounted for selective movement generally toward and away from the vacuum separator assembly to permit adjustment of the width of the marginal edge portion of the stack which overhangs said edge of the plate.

26. In a machine which is selectively adaptable for feeding either bulky, multiple-sheet articles or thin, single-sheet articles at a metered rate of delivery from a stack, the improvement comprising:

a chassis;

a delivery mechanism carried by the chassis and operable to withdraw the lowermost article from a stack of the articles and to feed the withdrawn article in a predetermined direction of delivery after a leading marginal edge of the article has first been presented to the mechanism;

an oscillating, bulky article separating rocker mounted on the chassis and operable to engage the bottom surface of the lowermost article in the stack during reverse motion of the rocker generally away from the delivery mechanism whereby to retract the leading marginal edge of the lowermost article back away from the leading marginal edge of the next higher article in the stack, said rocker then being operable during forward motion of the rocker generally toward the delivery mechanism to extend the retracted leading edge forwardly for presentation to the delivery mechanism;

means for selectively disabling the rocker; and a thin article vacuum separator selectively attachable to the chassis when the rocker is disabled for separating the leading marginal edge of the lowermost article in a stack of thin articles from the next higher article in the stack and presenting the separated marginal edge to the delivery mechanism, said vacuum separator including at least one vacuum head movable between a raised position in which the head adheres by suction to a bottom surface of the leading marginal edge of the lowermost thin article in the stack and a lowered position in which the head bends the adhered leading marginal edge of the lowermost thin article down to the delivery mechanism for engagement thereby.

27. In a machine as claimed in claim 26, said delivery mechanism including a pair of cooperating nip rollers.

28. In a machine as claimed in claim 26, said vacuum separator including a support having an upper surface disposed to underlie and support a stack of thin articles, said support having means for positioning the stack of thin articles in such a manner that a marginal edge portion of the stack overhangs and projects outwardly beyond a terminal edge of the support, said vacuum head of the separator being operable to oscillate between a raised position in which the head adheres to the marginal edge portion of the lowermost article and a lowered position in which the vacuum head presents the marginal edge portion of the lowermost article to the delivery mechanism.

29. In a machine as claimed in claim 28, said vacuum separator including a series of separate sucker heads mounted on a common rocker bar which extends generally along said terminal edge of the support, said bar having means at opposite ends thereof swingably mounting the bar on the frame for oscillation about an axis generally parallel to the bar and said terminal edge of the support, said separator including oscillating mechanism operably coupled with said rocker bar.

30. In a machine as claimed in claim 29, said chassis having drive means carried thereby for the rocker, said drive means including a rotary drive shaft, said drive shaft having a cam thereon and said oscillating mechanism including a follower in engagement with said cam for operating the oscillating mechanism.

31. In a machine as claimed in claim 30, said follower being provided with means yieldably biasing the follower into engagement with said cam.

32. In a machine as claimed in claim 31, said oscillating mechanism including a motion-transmitting, push-pull link between the follower and the rocker bar of the sucker assembly.

33. In a machine as claimed in claim 26, said vacuum separator including a frame having a pair of opposite side bars and transverse structure rigidly interconnecting said side bars, said frame being provided with a deck extending between said side bars and overlying said structure.

34. In a machine as claimed in claim 33, said machine including a pair of upright lateral sidewalls, each having inwardly projecting shoulder means on an upright, inner surface thereof, said side bars of the vacuum separator frame being disposed to rest on said shoulder means when the vacuum separator is installed in the machine, each of said side bars having means for detachably securing the side bars to the shoulder means.

* * * * *